US006598740B1

(12) United States Patent
Wiegers

(10) Patent No.: US 6,598,740 B1
(45) Date of Patent: Jul. 29, 2003

(54) TRAY FOR PACKAGING PORTIONS OF MEAT OR SIMILAR FOODS

(75) Inventor: Wilfried Wiegers, Heeslingen (DE)

(73) Assignee: J & T Company, Cayman Islands (KY)

( * ) Notice: Subject to any disclaimer, the term of this patent is extended or adjusted under 35 U.S.C. 154(b) by 0 days.

(21) Appl. No.: 09/857,765

(22) PCT Filed: Nov. 30, 1999

(86) PCT No.: PCT/EP99/09315

§ 371 (c)(1),
(2), (4) Date: Jun. 8, 2001

(87) PCT Pub. No.: WO00/34148

PCT Pub. Date: Jun. 15, 2000

(30) Foreign Application Priority Data

Dec. 8, 1998 (DE) ..... 198 56 494

(51) Int. Cl.[7] ..... B65D 81/26
(52) U.S. Cl. ..... 206/204; 426/124
(58) Field of Search ..... 206/204, 557; 229/119, 406; 426/106, 124, 129; 220/571

(56) References Cited

U.S. PATENT DOCUMENTS 3,040,949 A * 6/1962 Foote ..... 229/407
3,834,606 A * 9/1974 Andersson ..... 206/204
4,702,377 A * 10/1987 Grone ..... 206/557
6,216,855 B1 * 4/2001 Grone ..... 206/204

* cited by examiner

*Primary Examiner*—David T. Fidei
(74) *Attorney, Agent, or Firm*—Wells St. John P.S.

(57) ABSTRACT

The invention relates to a tray for packaging portions of meat or similar foods that are stored and presented in refrigerated conditions. Said tray is deep-drawn from polystyrene or a similar foam material, and has a base and a peripheral side wall. Said base and said side wall have a liquid-impermeable skin on the inside and the outside. This skin has recesses on the inside of the base and the foam layer that is located between the inner and outer skin is at least partially open-celled and has the effect of absorbing liquid. At least one channel is molded in the inside of the base, said channel essentially completely surrounding a section of the surface of the base and having flanks and a channel floor which also have a liquid-impermeable skin. The flank which is oriented towards said section of the surface has at least one recess which allows the passage of liquid.

27 Claims, 3 Drawing Sheets

TRAY FOR PACKAGING PORTIONS OF MEAT OR SIMILAR FOODS

CROSS-REFERENCE TO RELATED APPLICATION

This application claims the benefit, as a National stage entry of a PCT application pursuant to 35 U.S.C. §371, of International Application Number PCT/EP99/09315 filed Nov. 30, 1999, published in the German language, which in turn claims priority in its parent case, German patent DE 198 56 494 filed Dec. 8, 1998, both of which are incorporated by reference herein.

TECHNICAL FIELD

The invention pertains to trays. More particularly, the present invention relates to a tray for packaging portions of meat and similar foods stored and presented in refrigerated conditions.

The invention relates to a tray for packaging portions of meat and similar foods stored and presented in refrigerated conditions according to the preamble of patent claim 1.

BACKGROUND OF THE INVENTION

It is known to package portions of meat or poultry with the aid of plastic trays, the tray and content being wrapped in a transparent film of plastic. Such packs serve not only for storage purposes but also for presentation purposes. The content of the pack is clearly visible through the transparent film of plastic. Packs of this type are therefore often offered in refrigerated cabinets of supermarkets or the like.

The trays are usually molded from polystyrene foam by the thermoforming process. During the production process, liquid-impermeable skins are formed on the inside and outside of the tray. In order that any liquid escaping does not collect on the base of the tray, it is also known to make the foam absorbent by the formation of open-cell regions. The base of the tray is provided from the inside with a row of holes or apertures, via which liquid can penetrate into the interior of the foam layer.

If a tray of this type is inclined, there is the risk of the liquid absorbed in the base within the foam layer running to the border and escaping there. This of course has adverse effects on presentation. An escape of liquid can only be prevented if the free edge of the border is made liquid-impermeable.

If, on the other hand, the outer border is sealed, the liquid which runs via the film or the inside of the tray to the lowest-lying border is not taken up and absorbed. It collects at the low-lying border between the latter and the film and impairs the presentation of the product.

SUMMARY OF THE INVENTION

The invention is based on the object of providing a tray for packaging portions of meat or the like and similar foods stored and presented in refrigerated conditions in which absorbed liquid remains enclosed and does not run out even in an inclined position of the tray.

This object is achieved by the features of patent claim 1.

In the case of the tray according to the invention, the inside of the base has at least one channel completely surrounding a section of the surface of the base. The channel may be of any desired cross section, for example V-shaped, rectangular, with a curved bottom and straight flanks etc. What is important is that it is a closed or largely closed channel, which on account of liquid-impermeable walling can serve as a collecting channel for liquid. The channel preferably runs close to the border of the base or close to the side wall of the tray. As a result, that surface region which serves as an underlay for the content of the pack is surrounded by the channel.

The channel described provides the basis for an advantage over customary packaging trays, the base of which is provided with a number of holes or punched perforations, which are covered to a greater or lesser extent by the content of the pack, for example a piece of meat. The covered holes or punched perforations do not serve for the removal of escaped liquid. Liquid which collects on the base of the tray is only carried away and absorbed via the remaining holes or punched perforations.

In the case of the tray according to the invention, liquid runs from the section of the surface surrounded by the channel, which has a liquid-impermeable outer layer or skin, into the channel and collects there. The in fact liquid-impermeable walling of the channel is provided according to the invention with at least one aperture allowing the passage of liquid. Along the channel there is preferably a row of apertures, via which liquid can enter the liquid-absorbent layer of the base from the channel. Since the apertures are formed only in that flank of the channel which is facing the enclosed surface section, it is also only this section that serves for liquid absorption, while liquid does not penetrate into the border region of the tray from the outset. Consequently, liquid also cannot escape via the free edge. The region between the base of the tray and the bottom of the channel is liquid-impermeable due to the forming of the channel. As a result, the liquid absorbed in the surface section of the base enclosed by the channel remains enclosed, irrespective of the inclination of the tray.

It is conceivable to interrupt the channel at one or more points. Similarly, "bridges" with more or less liquid-permeable regions can be formed between the bottom of the channel and the base of the tray, without significantly impairing the general effect of the channel. Such a measure may be expedient to compensate at least partially for the loss in strength of the tray caused by the channel.

According to the design of the invention, the aperture may be formed as a hole-shaped punched perforation, which is made in the skin and the layer lying thereunder, as is the case in known trays. In the latter case, however, the punched perforations are distributed over the surface of the base.

In the present description, reference is made predominantly to trays which are molded from polystyrene foam by the thermoforming process and, on account of the production process, have a liquid-impermeable skin on the inside and outside. It goes without saying, however, that the invention also applies to those trays which are made up of a plurality of layers, for example an inner absorbent layer and at least one liquid-impermeable second layer, covering the inside. It also goes without saying that not only open-cell polystyrene foam comes into consideration for the absorbent layer but also open-cell foam of other plastics or an absorbent material acting in a different way.

In order that as large a surface area of the base as possible is enclosed, another design of the invention provides that the channel is formed in the base near the side wall.

The forming of a channel in the base of a tray means of course a weakening of its strength. In order that the weakening is minimized, another design of the invention provides that the channel adopts a changing direction in its path. The channel may, for example, run in a zigzagging or meandering form. It may have the shape of a dog's bone. In principle, a wide variety of configurations are possible.

In particular in the case of surface sections covering only part of the base, it may be advantageous according to a further design of the invention to form branch channels in the base and possibly also in the inner side wall, via which liquid can flow to the peripheral channel.

In the case of conventional trays, it is disadvantageous if the free edge of the outwardly bent border of the tray is liquid-permeable. As mentioned above, in the case of known trays this can cause the liquid to escape and collect between the border and the film. In the case of the tray according to the invention, on the other hand, a liquid-permeable border is advantageous. Liquid which collects along the film or in some other way in the free border region can then enter the side wall, which like the base contains an inner liquid-absorbent layer, via the liquid-permeable edge by capillary action.

The take-up of liquid in the border region of the tray is further improved according to one design of the invention if elevations are formed at intervals on the upper side of the outwardly bent border. The elevations or protrusions have the effect of creating a gap between the film and the border surface, via which liquid can pass more easily over the border and enter the side wall over the free edge.

BRIEF DESCRIPTION OF THE DRAWINGS

Exemplary embodiments of the invention represented in the drawings are explained in more detail below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
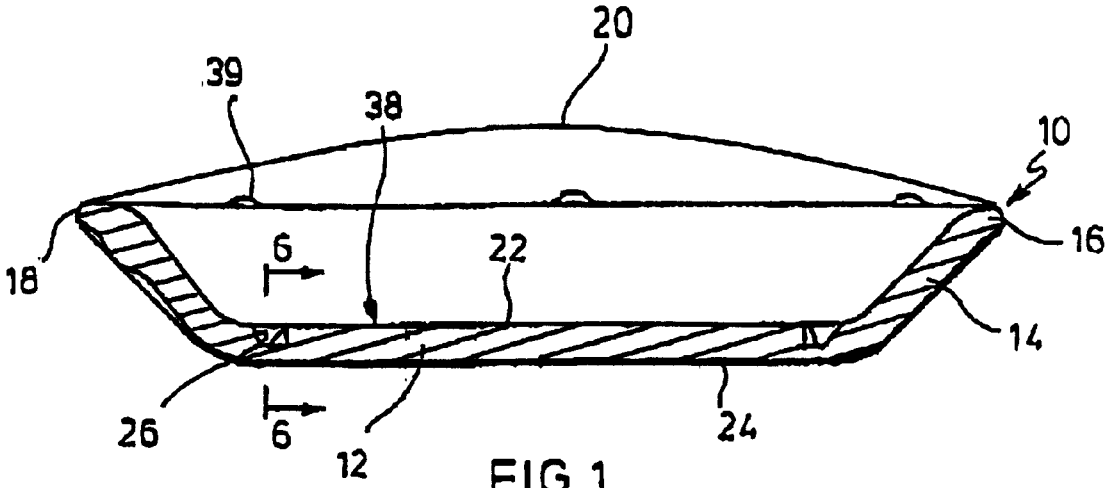
FIG. 1 shows a section through a tray according to the invention.
Figure 2:
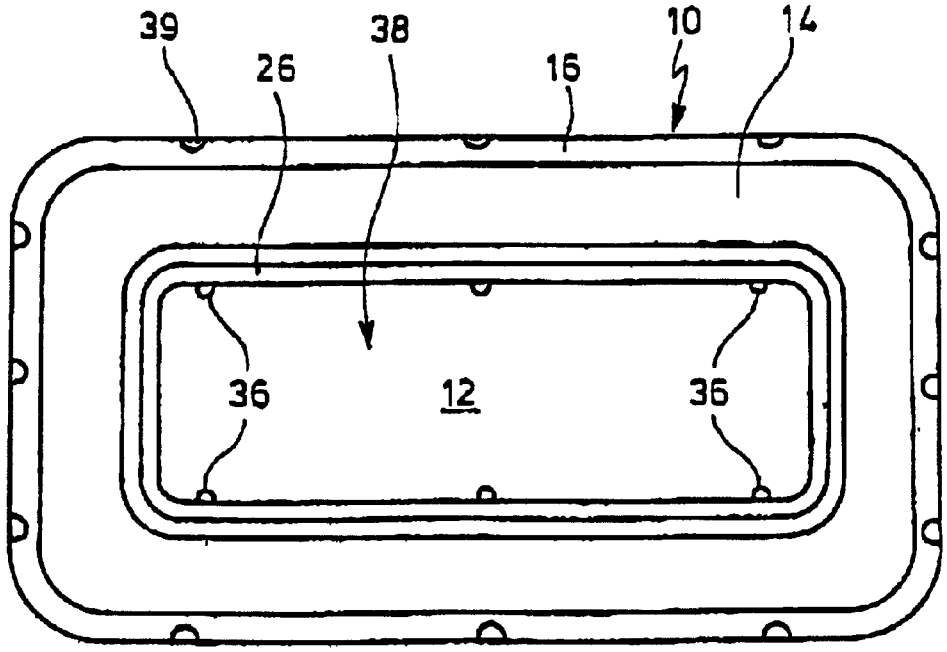
FIG. 2 shows the plan view of the tray according to FIG. 1.

A tray 10 is represented in FIGS. 1 and 2. It has a base 12 and a side wall 14, which is given greater strength by external impressions. However, these are not considered in detail. They are state of the art. The side wall 14 has an outwardly bent-away border 16 with a free edge 18. It is also shown in FIG. 1 how a transparent film of plastic 20 encloses the entire tray 10. The film of plastic 20 is indicated in such a way as though there were an item, for example a portion of meat or the like, in the tray 10.

The tray 10, formed in one piece, is produced from polystyrene or similar material, to be precise by the thermoforming process. The type of production has the effect that on the inside and outside of the tray 10 there respectively forms a skin 22 and 24, which is liquid-impermeable. The layer of foam lying between is partially open-cell. It is therefore suitable like a sponge for the absorption of liquid.

Figure 6:
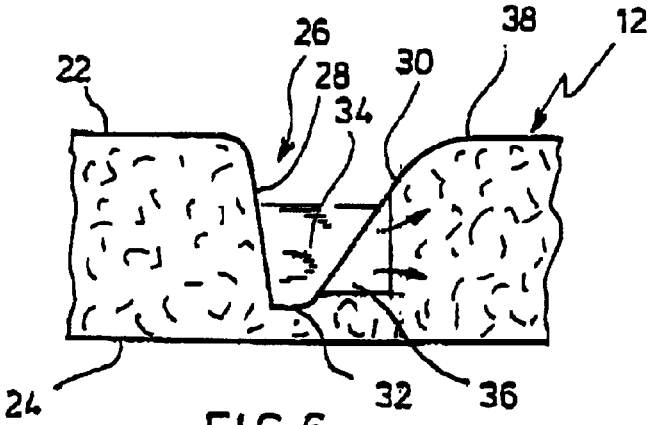
FIG. 6 shows a section through the tray according to FIG. 1 along the line 6—6.

As can be seen from FIGS. 1 and 2, the inner bottom surface of the base 12 is surrounded by a channel 26, which is formed into the base from its inside. This is clearly shown by FIG. 6.

The channel 26 has flanks 28, 30 and a bottom 32. They bound the channel 26 on the side and from below. As can be seen, the bottom 32 ends at a distance from the lower skin 24 of the base 12. The walling of the channel is liquid-impermeable, as is the walling of the remaining sections of the tray. Liquid, as indicated at 34, can therefore collect in the channel 26. The region between the bottom 32 of the channel and base 24 of the tray is liquid-impermeable on account of the forming of the channel 26. As a result, the region enclosed by the channel 26 forms a largely closed chamber, which receives the liquid from the channel 26.

However, punched perforations 36 are made at intervals in the flank 30 facing the inner surface section 38. These punched perforations penetrate the skin of the flank 30. They consequently make it possible for the liquid 34 to enter into the interior of the base section 38 enclosed by the channel 26. As a result, the liquid collecting in the channel 26 can be absorbed in the base section 38. On the other hand, the channel prevents liquid from penetrating into the side wall 14 of the tray 10, even if the tray is arranged such that it is inclined with respect to the horizontal. Running out of liquid over the border to the outside is thus avoided.

Figure 8:
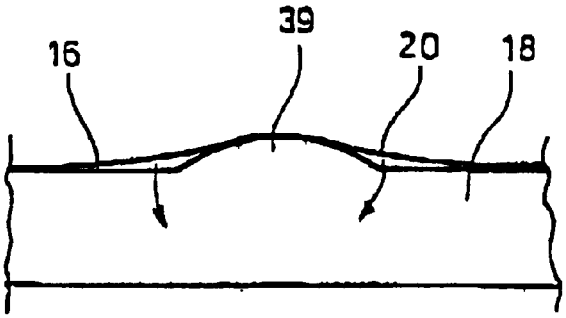
FIG. 8 shows the side view of part of the free edge of the side wall of the tray according to FIG. 1.

In FIG. 2 it can be seen that protrusions 39 are formed at intervals on the upper side of the border 16. These protrusions have the effect that the film 20, as shown in FIG. 8, forms in the region of the free edge 18 a distance from the border 16, via which liquid can get to the free edge 18. Since the free edge is liquid-permeable, consequently has no liquid-impermeable skin, liquid which collects on one side at the border 16 can enter via the edge 18 and be absorbed. In this case, the wall 14 serves as an absorption volume, its size being adequate in relation to the amount of liquid occurring to hold the liquid by capillary action alone. Running out of liquid absorbed in the base section 38 via the border 14 and the free edge 18 is in any event prevented.

Figure 3:
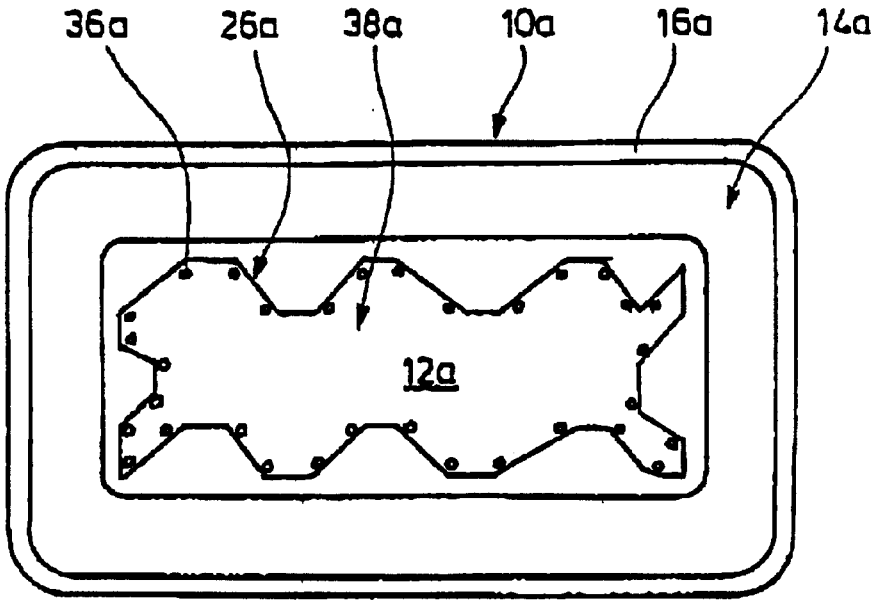
FIG. 3 shows the plan view of another embodiment of a tray according to the invention.

In the case of the tray according to FIG. 3, a peripheral channel 26*a* is laid out in a zigzag form. On the flank or channel facing the enclosed section of the surface, punched perforations 36*a* are again provided, similar to the punched perforations 36 in the case of the tray 10 according to FIGS. 1 and 2. The zigzag path has the effect that the strength of the tray is weakened much less than is the case with a rectangular path of the channel 26 according to FIG. 2.

Figure 4:
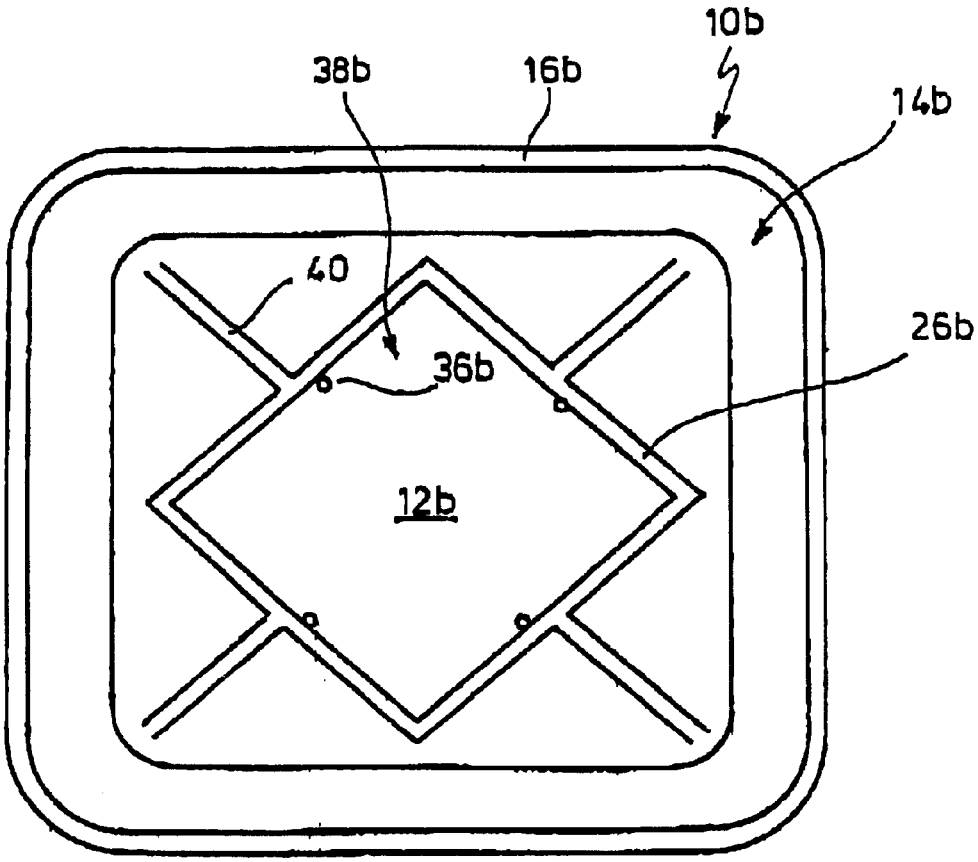
FIG. 4 shows the plan view of a third embodiment of a tray according to the invention.

FIG. 4 shows a tray 10*b* which is constructed in a way similar to the trays according to FIGS. 1 to 3. A peripheral channel 26*b* has a rhombic shape. The 20 enclosed surface section 38*b* is in turn provided with punched perforations 36*b* adjacent to the channel 26*b*, in a way similar to the punched perforations 36 and 36*a* according to FIGS. 1 to 3. In addition, branch channels 40 are provided, extending from the corners of the base 12 approximately perpendicularly with respect to the associated section of the channel 26*b*. The four branch channels 40 serve as feed channels, which convey liquid collecting in neighboring sections of the base 12*b* to the channel 26*b*.

Figure 5:
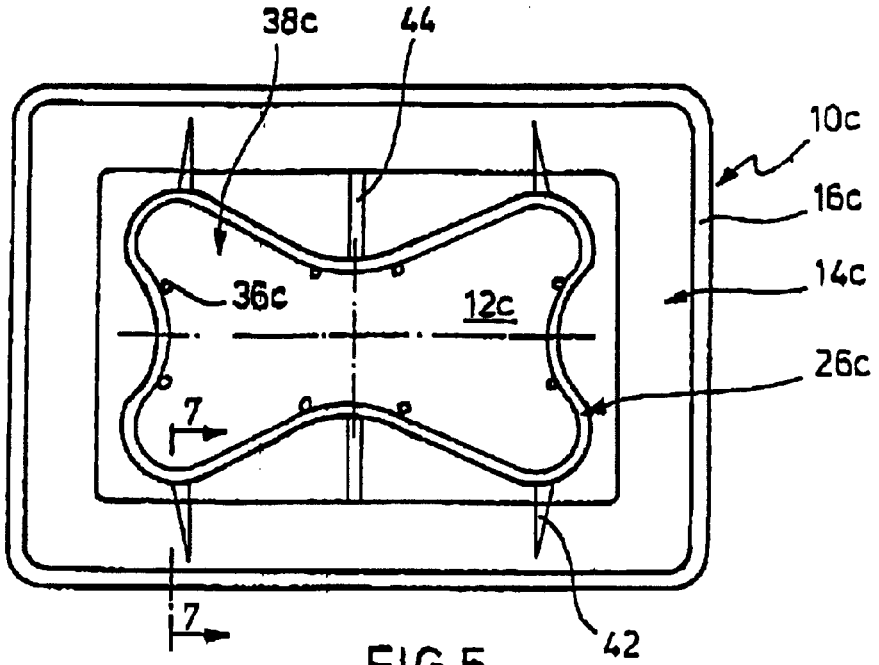
FIG. 5 shows a plan view of a fourth embodiment of a tray according to the invention.
Figure 7:
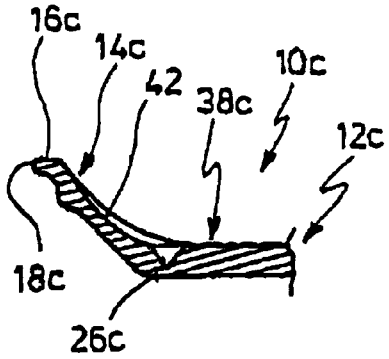
FIG. 7 shows a section through the tray according to FIG. 5 along the line 7—7.

In the case of the embodiment according to FIG. 5, the base 12*c* of the tray 10*c* has a channel 26*c* in the shape of a dog's bone, punched perforations 36*c* having been made in the enclosed surface section 38*c* or in the channel 26*c*, resembling the punched perforations 36 to 36*b* according to the embodiments above. Branch channels 42 are formed on the inner side of the side wall 14*c*. They extend from the side wall over the outer section of the base to the channel 26*c*. This can also be seen in the section according to FIG. 7. The branch channels 42 serve as drainage for liquid in the direction of the channel 26*c*, as do further branch channels 44, which are formed in the base 12*c*.

It goes without saying that indentations, holes or the like, which serve in a conventional way for the take-up of the liquid, may be formed in the base in addition to the channel in the enclosed volume.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A thermoformed tray for packaging food, comprising: a base and a peripheral side wall, the base and side wall having a liquid-impermeable skin on an inside surface and an outside surface and a layer of foam between the inside skin and the outside skin, a plurality of apertures provided through the inside skin over the base, and the layer of foam lying between the inside skin and the outside skin being at least partially open-cell and acting in a liquid-absorbing manner, at least one channel, surrounding an enclosed surface section of the base, is formed into the inside of the base, with flanks and a channel bottom, which has a liquid-impermeable skin, a volume of the base that is assigned to the enclosed surface section being separated in a liquid-impermeable manner from neighboring sections, and the flank facing the surface section having at least one aperture allowing a passage of liquid.

2. The tray as claimed in claim 1, characterized in that the aperture is formed by a hole-shaped punched perforation.

3. The tray as claimed in claim 1, characterized in that the channel is formed in the base near the side wall.

4. The tray as claimed in claim 1, characterized in that the channel adopts a changing direction in its path.

5. The tray as claimed in claim 4, characterized in that the channel runs in a zigzagging or meandering form.

6. The tray as claimed in claim 1, characterized in that the channel has the shape of a dog's bone.

7. The tray as claimed in claim 1, characterized in that branch channels which are connected to the channel are formed in the base and/or in the side wall and the surfaces bounding the branch channels are liquid-impermeable.

8. The tray as claimed in claim 7, characterized in that the branch channels meet the channel almost perpendicularly.

9. The tray as claimed in claim 1, characterized in that the free edge of the outwardly bent free border of the side wall is liquid-impermeable.

10. The tray as claimed in claim 1, characterized in that elevations are formed at intervals on the upper side of the outwardly bent border of the side wall.

11. The tray as claimed in claim 2, characterized in that the channel is formed in the base near the side wall.

12. The tray as claimed in claim 2, characterized in that the channel adopts a changing direction in its path.

13. The tray as claimed in claim 3, characterized in that the channel adopts a changing direction in its path.

14. The tray as claimed in claim 3, characterized in that the channel has the shape of a dog's bone.

15. The tray as claimed in claim 8, characterized in that the free edge of the outwardly bent free border of the side wall is liquid-permeable.

16. The tray as claimed in claim 2, characterized in that elevations are formed at intervals on the upper side of the outwardly bent border of the side wall.

17. The tray as claimed in claim 4, characterized in that elevations are formed at intervals on the upper side of the outwardly bent border of the side wall.

18. The tray as claimed in claim 7, characterized in that elevations are formed at intervals on the upper side of the outwardly bent border of the side wall.

19. The tray as claimed in claim 8, characterized in that elevations are formed at intervals on the upper side of the outwardly bent border of the side wall.

20. The tray as claimed in claim 9, characterized in that elevations are formed at intervals on the upper side of the outwardly bent border of the side wall.

21. A thermoformed tray for liquid-secreting foods, comprising:

a base having an inside liquid-impermeable layer, an outside liquid-impermeable layer, and a liquid absorbent layer provided between the inside layer and the outside layer;

a peripheral side wall extending about the base;

a channel formed in an inner surface of the base and bounded by the inside liquid-impermeable layer being disposed into the liquid- absorbent layer so as to render the channel liquid-impermeable, the channel defining an enclosed surface section in the base and a liquid-absorbent base portion provided by the liquid absorbent layer therebelow being separated in a liquid-impermeable manner from any neighboring portion; and at least one perforation through the inside liquid-impermeable layer provided at least in part along the channel and configured to allow passage of liquid from the channel into the liquid-absorbent base portion.

22. The tray of claim 21 wherein the base and the peripheral side wall are integrally formed from a sandwich of the liquid impermeable inner layer, the liquid absorbent layer, and the liquid impermeable outer layer.

23. The tray of claim 21 wherein the channel comprises a non-circular, closed channel.

24. The tray of claim 21 wherein the channel forms a liquid impermeable wall about the liquid absorbent base portion.

25. The tray of claim 21 wherein a plurality of the perforations are provided spaced-apart along the channel via which liquid can enter the liquid absorbent layer of the liquid absorbent base portion.

26. The tray of claim 21 wherein the channel is thermoformed into the base and the region between the base of the tray and the bottom of the channel is liquid-impermeable due to forming of the channel.

27. The tray of claim 21 further comprising at least one liquid-impervious branch channel communicating with the channel and radiating outwardly of the channel via which liquid can flow to the channel from the branch channel.

* * * * *

UNITED STATES PATENT AND TRADEMARK OFFICE

CERTIFICATE OF CORRECTION

PATENT NO. : 6,598,740 B1
DATED : July 29, 2003
INVENTOR(S) : Wilfried Wiegers

It is certified that error appears in the above-identified patent and that said Letters Patent is hereby corrected as shown below:

Column 1,
Lines 20-22, should be deleted.

Column 4,
Line 55, delete "The 20 enclosed surface", and insert -- The enclosed surface --.

Signed and Sealed this

Twenty-third Day of September, 2003

JAMES E. ROGAN
*Director of the United States Patent and Trademark Office*